US006935976B1

(12) United States Patent
Grace, Jr. et al.

(10) Patent No.: US 6,935,976 B1
(45) Date of Patent: Aug. 30, 2005

(54) MECHANICAL BROADHEAD WITH SLIDING BLADES

(75) Inventors: Louis Grace, Jr., North Street, MI (US); Nathaniel E. Grace, St. Clair, MI (US)

(73) Assignee: G5 Outdoors, L.L.C., Memphis, MI (US)

( * ) Notice: Subject to any disclaimer, the term of this patent is extended or adjusted under 35 U.S.C. 154(b) by 71 days.

(21) Appl. No.: 10/706,736

(22) Filed: Nov. 12, 2003

(51) Int. Cl.[7] ..... F42B 6/08
(52) U.S. Cl. ..... 473/583
(58) Field of Search ..... 473/583, 584

(56) References Cited

U.S. PATENT DOCUMENTS

| | | | | |
|---|---|---|---|---|
| 3,138,383 | A * | 6/1964 | McKinzie | 473/583 |
| 4,099,720 | A | 7/1978 | Zeren | |
| 4,166,619 | A | 9/1979 | Bergmann et al. | |
| 4,579,348 | A * | 4/1986 | Jones | 473/583 |
| 4,932,671 | A | 6/1990 | Anderson, Jr. | |
| 5,078,407 | A | 1/1992 | Carlston et al. | |
| 5,112,063 | A | 5/1992 | Puckett | |
| 5,172,916 | A | 12/1992 | Puckett | |
| 5,178,398 | A | 1/1993 | Eddy | |
| 5,322,297 | A | 6/1994 | Smith | |
| 5,458,341 | A | 10/1995 | Forrest et al. | |
| 5,472,213 | A | 12/1995 | Dudley | |
| 5,564,713 | A | 10/1996 | Mizek et al. | |
| 5,803,844 | A | 9/1998 | Anderson | |
| 5,820,498 | A | 10/1998 | Maleski | |
| 5,857,930 | A | 1/1999 | Troncoso | |
| 5,879,252 | A | 3/1999 | Johnson | |
| 5,931,751 | A | 8/1999 | Cooper | |
| 6,200,237 | B1 * | 3/2001 | Barrie | 473/583 |
| 6,217,467 | B1 | 4/2001 | Maleski | |
| 6,322,464 | B1 | 11/2001 | Sestak | |
| 6,517,454 | B2 * | 2/2003 | Barrie et al. | 473/583 |
| 6,595,881 | B1 | 7/2003 | Grace, Jr. et al. | |
| 6,626,776 | B2 * | 9/2003 | Barrie et al. | 473/583 |
| 6,669,586 | B2 * | 12/2003 | Barrie et al. | 473/583 |

* cited by examiner

*Primary Examiner*—John A. Ricci
(74) *Attorney, Agent, or Firm*—Harness, Dickey & Pierce, P.L.C.

(57) ABSTRACT

The present invention provides a mechanical broadhead in which the blades slide within longitudinal channels formed in the ferrule. The blade includes a transverse boss extending from the flanks which are received in a channel formed in the ferrule. A camming surface formed on the inward edge of the blades cooperate with a collar to provide controlled radial movement of the blades as they slide rearwardly within the channel on the ferrule.

34 Claims, 9 Drawing Sheets

MECHANICAL BROADHEAD WITH SLIDING BLADES

FIELD OF THE INVENTION

The present invention relates generally to mechanical or expanding-blade broadheads, and more particularly to a mechanical broadhead in which the blades slide within a longitudinal channel formed in the ferrule.

BACKGROUND OF THE INVENTION

A mechanical or expanding-blade broadhead is a type of broadhead in which the blades are operably coupled to the ferrule in a manner to move from an in-flight, retracted position to an on-impact, deployed position. This configuration of a broadhead is beneficial in that it has flight characteristics similar to those of a field point tip and penetration characteristics similar to those of a fixed blade broadhead.

The most popular type of mechanical broadhead has one or more blades located within a slot such that the cutting edge is on the radially inward edge of the blade. The blade is pivotally coupled to the rearward portion of the ferrule so that it may rotate from a retracted position to a deployed position about the pivot on impact within a target, thereby exposing the cutting edge formed on the blade. This type of mechanical broadhead has performed with varying degrees of success. However, substantial kinetic energy is required to rotate the blade about the pivot from the retracted position to the deployed position. As a result, less kinetic energy is available for target penetration on impact.

Another less-common type of mechanical broadhead includes one or more blades which longitudinally slide relative to the ferrule from the in-flight, retracted position to the on-impact deployed position. Specifically, the blades in this sliding-type mechanical broadhead are disposed within a longitudinal groove formed in the ferrule such that the cutting edge of the blades extend radially outwardly. A lost-motion slot is formed in the interior of the blade and receives a pin extending through the ferrule to operably couple the blade thereto. During flight, the blades are closely positioned to the ferrule, and upon impact the blades slide rearwardly through a range of motion defined by the slot to the deployed position.

The sliding-type mechanical broadhead are in principle better than the pivoting-type mechanical broadheads in that they require less kinetic energy to move the blades from the retracted position to the deployed position. However, the current designs of such broadheads are less robust than other types of mechanical broadheads. Specifically, a ferrule in a sliding-type broadhead is typically fabricated from an aluminum alloy due to the required geometric complexity. Furthermore, the slot formed in the blades reduces the overall stiffness and durability thereof.

Recent developments in the broadhead art, and in particular use of powder injection molding for the manufacture of components, have added significant flexibility in the design and manufacture of broadheads. This manufacturing technology allows a broadhead designer to make fine details and features as integral parts of the broadhead component. Furthermore, this technology enables design features such as a tapered blade to be utilized.

SUMMARY OF THE INVENTION

The present invention is directed to a mechanical broadhead in which a set of blades are operably coupled to the ferrule to slide within a longitudinal channel formed therein from an in-flight, retracted position to an on-impact deployed position. Specifically, each blade has a boss extending from a flank of the blade. The channel formed in the ferrule is complimentary with the boss such that the blade freely slides within the channel. A lip formed on the surface of the ferrule at the channel captures and retains the blade within the ferrule while permitting the desired relative sliding movement. A collar or insert such as that used within the end of an arrow shaft is positioned at the rearward face of the ferrule. The collar functions to retain the blades within the channel and to provide a cam upon which the blade is moved radially outward in coordination with the longitudinal sliding movement.

In one aspect, the present invention is directed to a sliding-type mechanical broadhead in which the blades of the broadhead have a boss extending transversely from a flank of the blade which is received within a channel formed in the ferrule to opearbly couple the blade to the ferrule.

Another aspect of the present invention is directed to a sliding-type mechanical broadhead in which the blade, and more particularly the rearward end of the blade has a improved path of travel with an initial movement which is substantially parallel to the longitudinal axis of the channel formed in the ferrule prior to sliding rearwardly and rotating outwardly during the balance of the blade travel.

A further aspect of the present invention is to provide an improved design for a sliding-type mechanical broadhead in which the blades may be readily replaced.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 6:
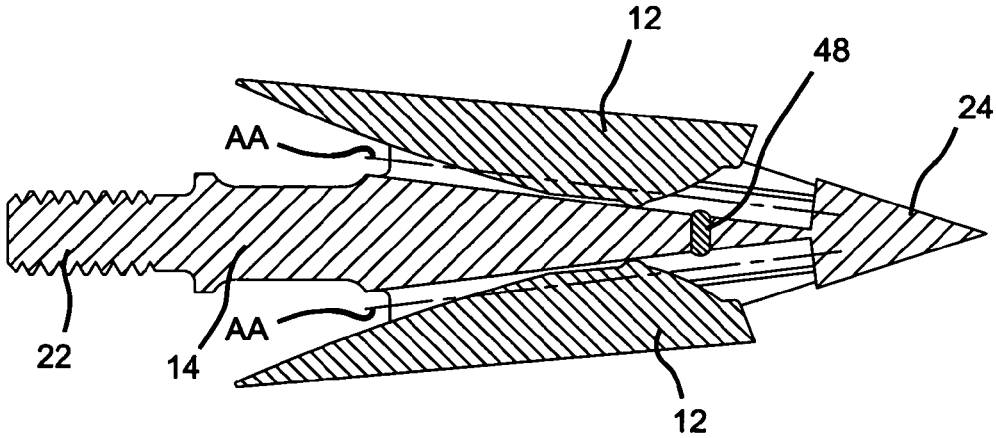
FIG. 6 is a cross-section similar to FIG. 5 in which the blades are shown in a partially deployed position.
Figure 7:
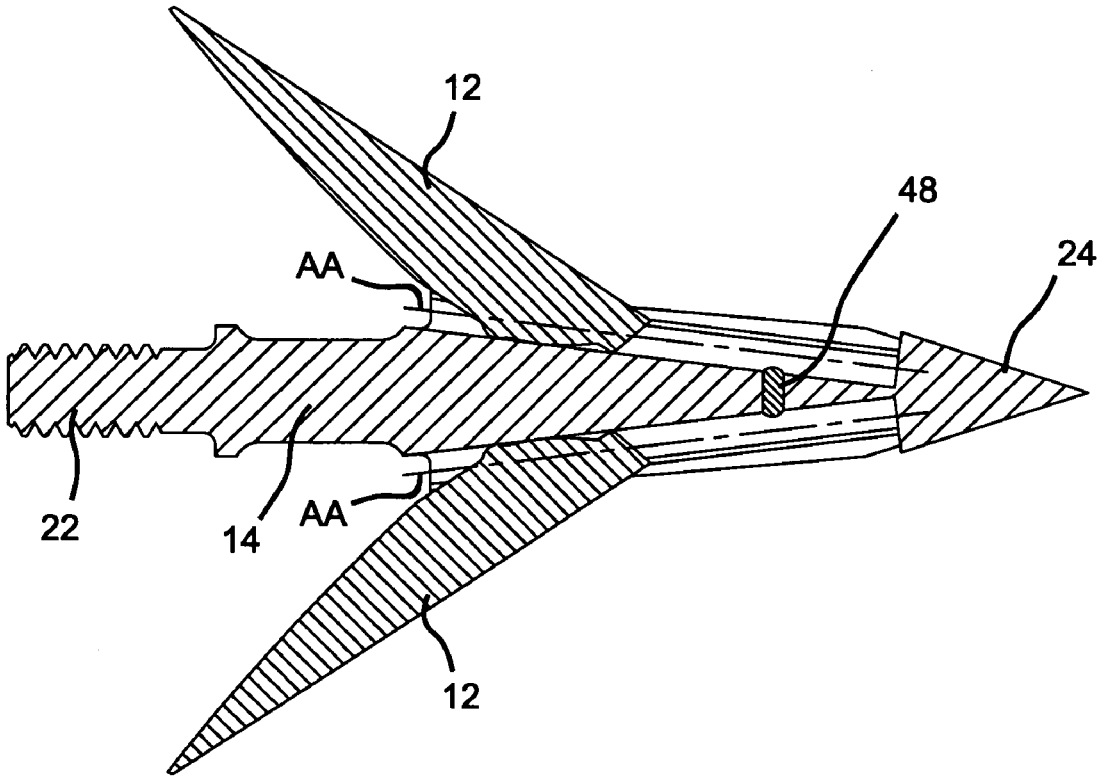
FIG. 7 is a cross-section similar to FIG. 5 in which the blades are shown in the fully deployed position.
Figure 8:
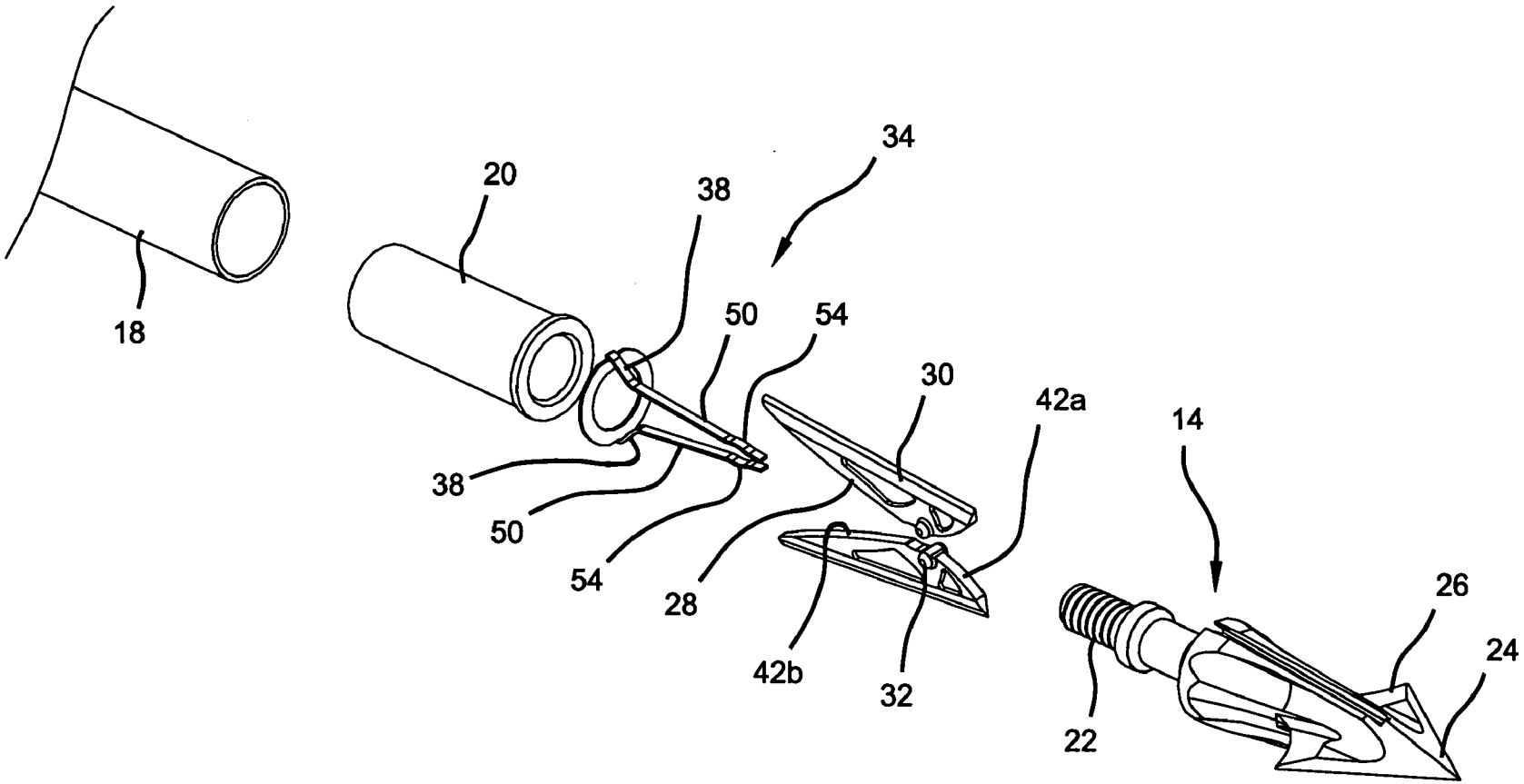
FIG. 8 is an exploded perspective view of a mechanical broadhead in accordance with a second preferred embodiment of the present invention.
Figure 9:
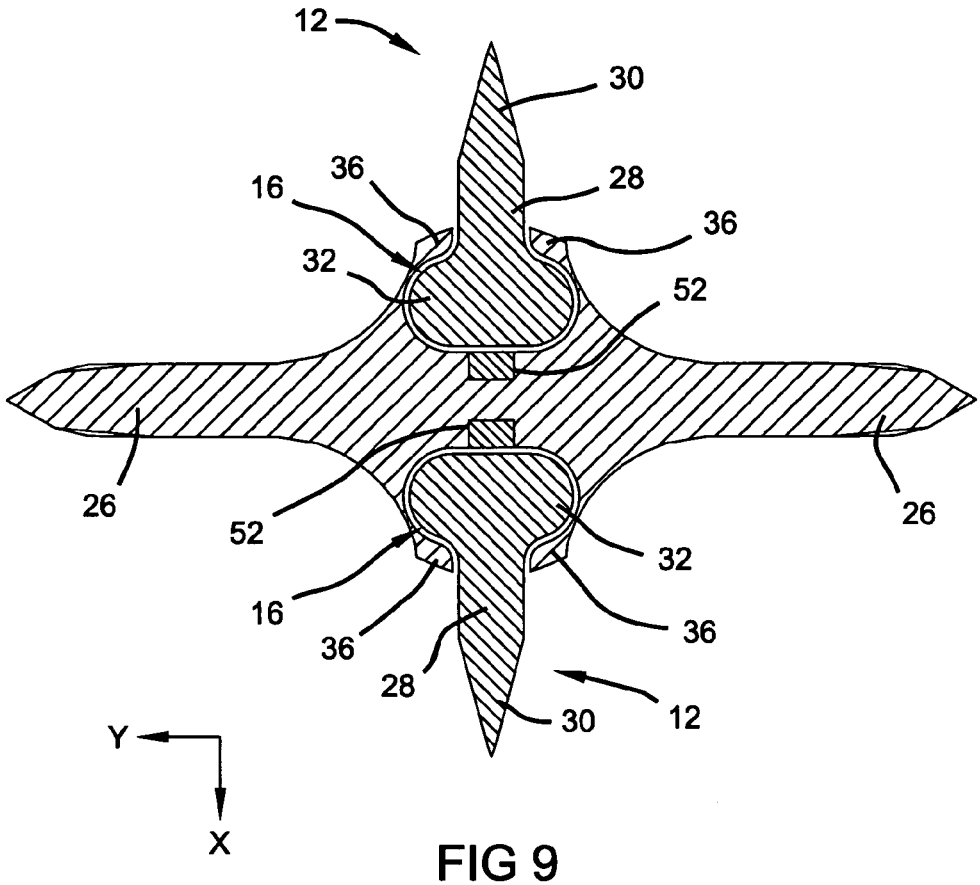
FIG. 9 is a transverse cross-section taken through the blade at the boss.
Figure 10:
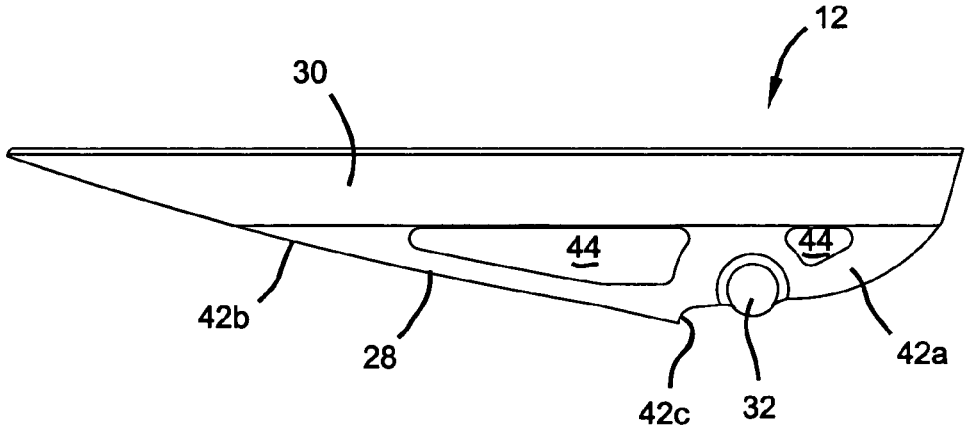
FIG. 10 is a side view of the blade shown in FIG. 8.
Figure 12:
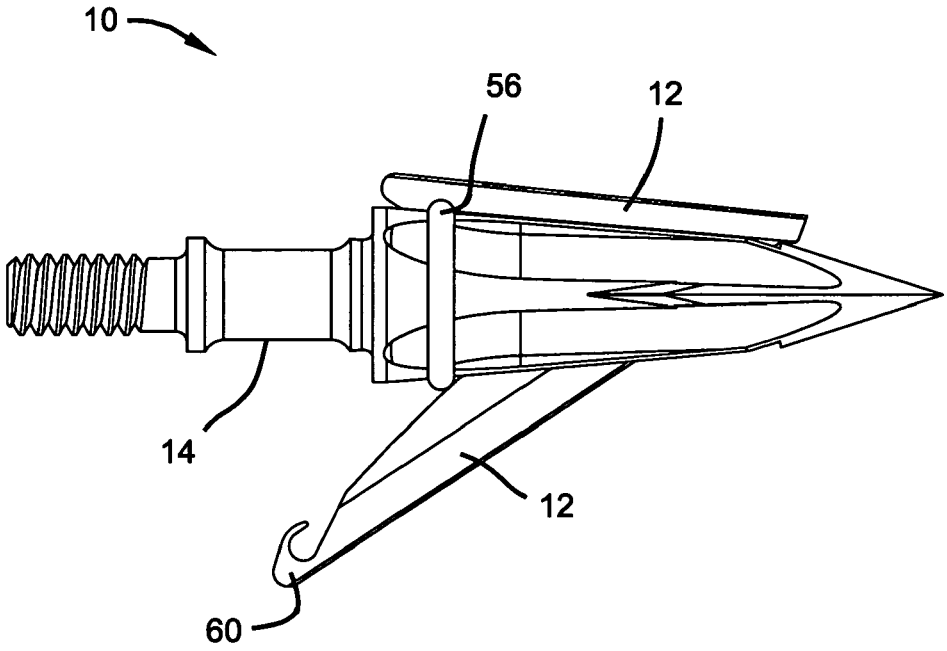
FIG. 12 is a side view of a mechanical broadhead in accordance with a third preferred embodiment of the present invention in which the upper blade is shown in a retracted position and the lower blade is shown in a deployed position.
Figure 13:
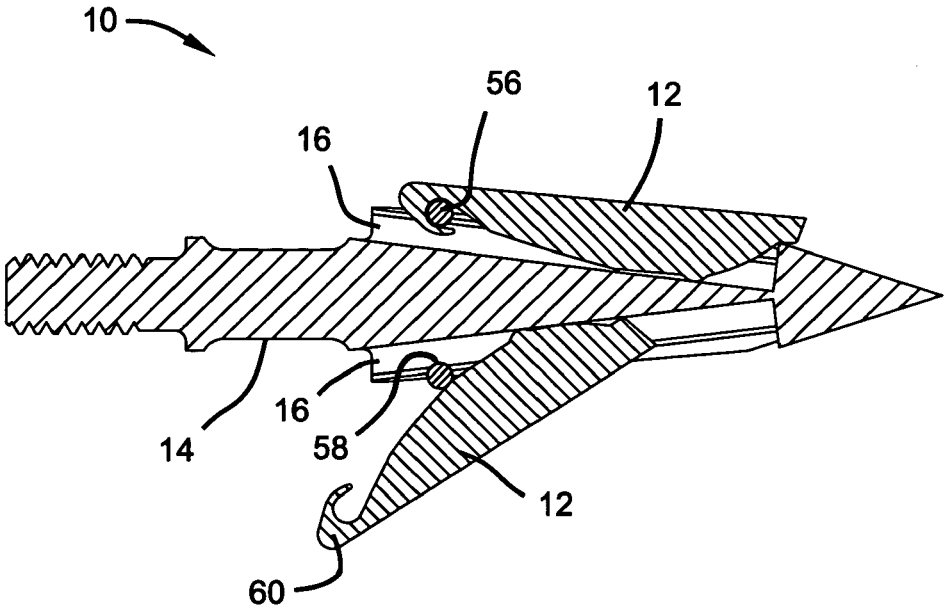
FIG. 13 is a cross-sectional of the broadhead of FIG. 12.

With reference to the Figures, a first preferred embodiment of the present invention is illustrated in FIGS. 1–7, a second preferred embodiment of the present invention is illustrated in FIGS. 8–10 and a third preferred embodiment is illustrated in FIGS. 12 and 13. Unless specifically noted, it will be understood that the three preferred embodiments share the same or similar features. The present invention is directed to a mechanical broadhead 10 having multiple blades 12 operably coupled to a ferrule 14 such that the blades 12 slide within a channel 16 formed longitudinally in the ferrule 14. Blades 12 are slidably positionable within channel 16 from an in-flight, retracted position to an on-impact, deployed position. The broadhead 10 is secured to an arrow shaft 18 through insert 20. As presently preferred, ferrule 14 has a shank portion 22 with an external thread formed thereon for releasably securing the ferrule 14 to the insert 20. A tip portion 24 is formed on the ferrule 14 opposite the shank portion 22 to provide a cutting edge for broadhead 10. As illustrated in the figures, tip portion 24 is integral with the body of the ferrule 14. Tip portion 24 is a hybrid tip having a tapered nose with a pair of fixed cutting blades 26 extending laterally from the ferrule 14. While the present invention is illustrated with a hybrid tip, one skilled in the art will recognize that a mechanical broadhead in accordance with the present invention could be provided with a variety of tip portions such as a trocar point or a conventional field point.

Figure 1:
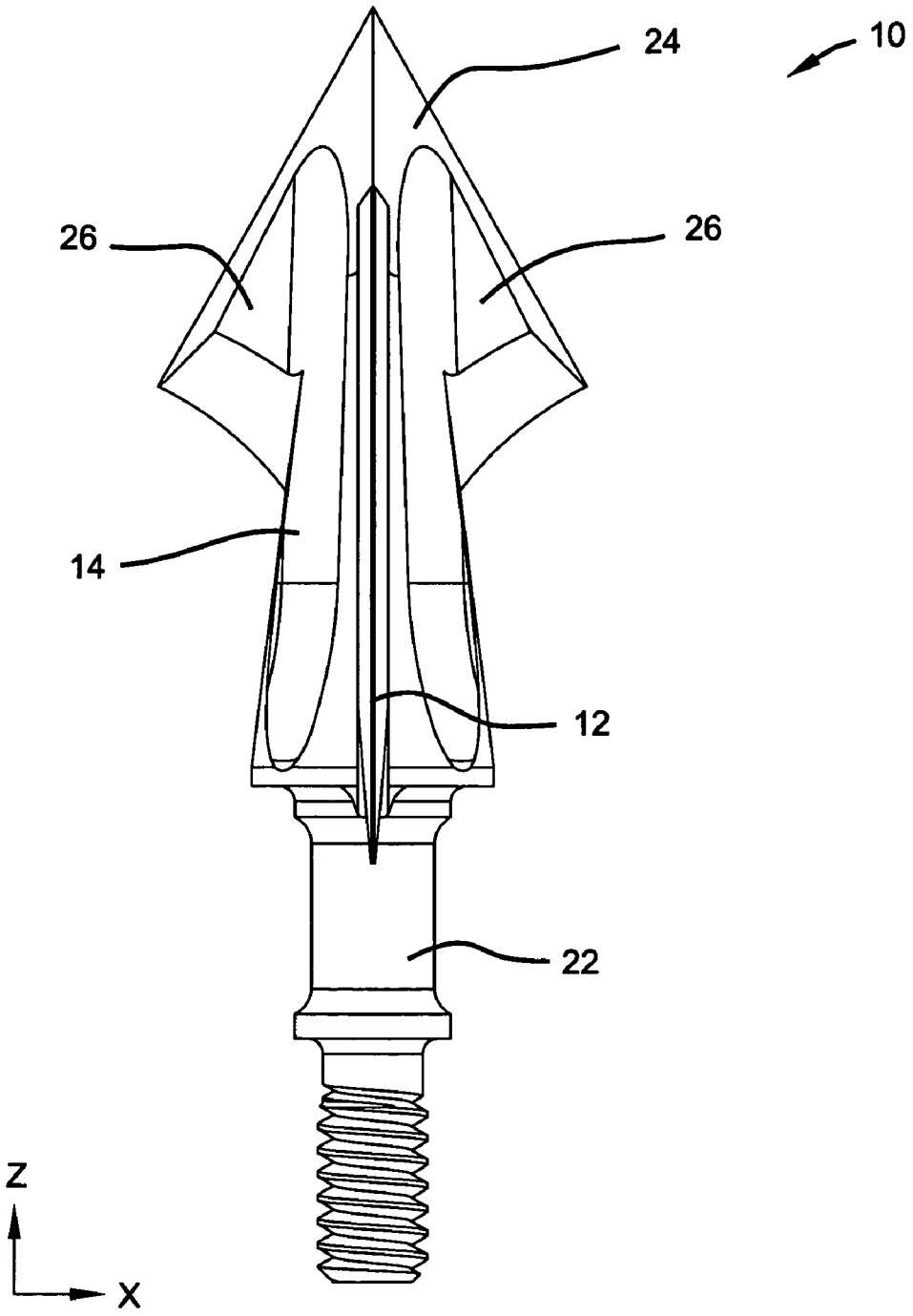
FIG. 1 is a top view of a mechanical broadhead in accordance with a first preferred embodiment of the present invention with the blades shown in a retracted position.
Figure 2:
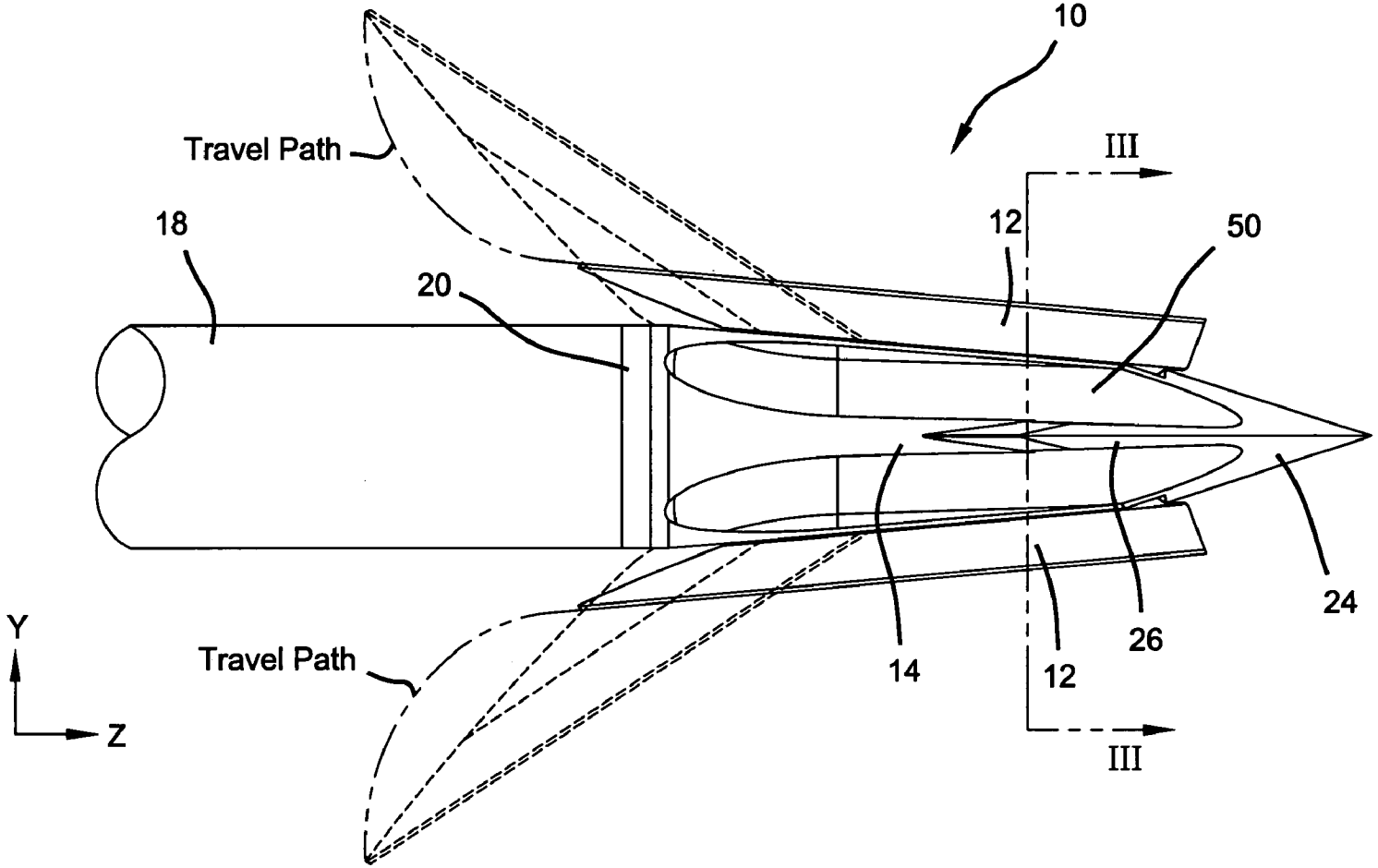
FIG. 2 is a side view of the broadhead illustrated in FIG. 1 with the blades shown in solid lines in the retracted position and broken lines in the deployed position.
Figure 11:
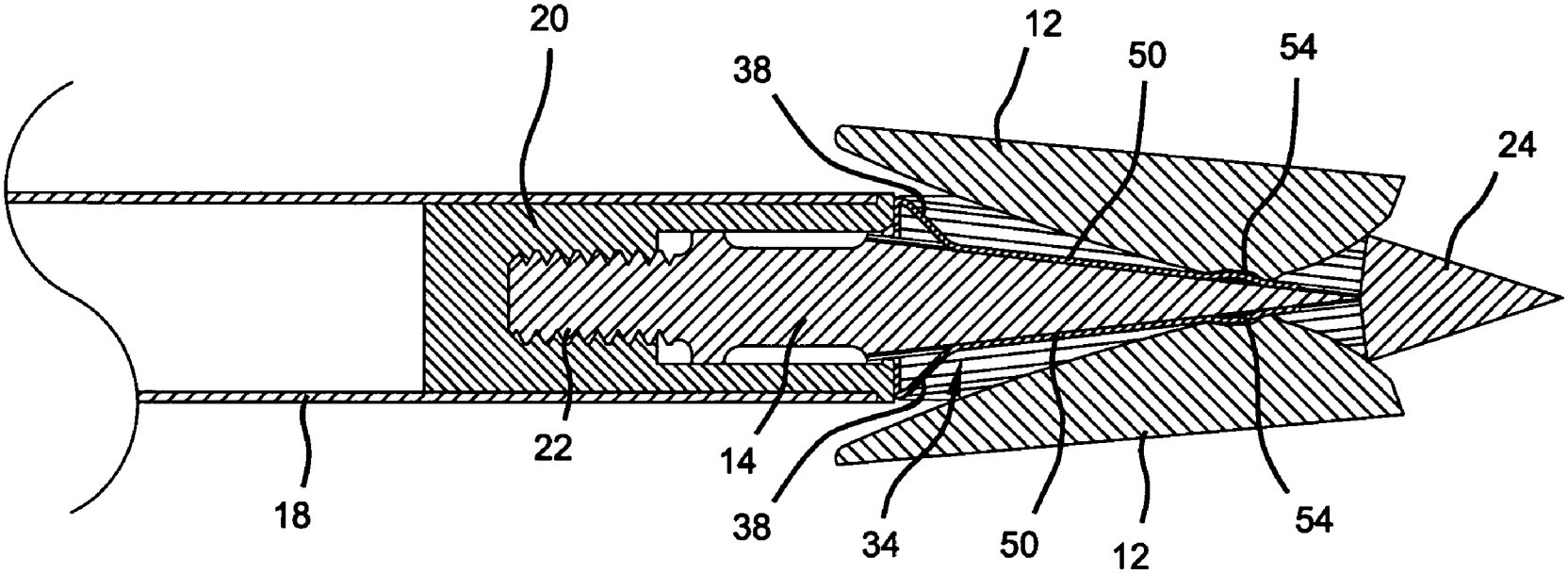
FIG. 11 is a cross-section of the broadhead of FIG. 8 in which the blades are shown in the retracted position.

With reference now to FIGS. 3–4 and 9–10, each of the blades 12 have a generally planar flank portion 28 and a tapered edge portion 30 terminating at a sharpened edge. A boss 32 extends transversely from the planar flank 28 and is received within channel 16 to operably couple the blades 12 with the ferrule 14. Channel 16 is configured to be complementary with the boss 32. Channel 16 has a geometry which is generally complementary of the boss 32 and a lip 36 which cooperates with the boss 32 to retain the blade 12 in the ferrule 14. The boss 32 and a portion of the blade flank 28 are received within the channel 16. In the first embodiment, the insert 20 located adjacent the ferrule 14 functions as a collar to retain the boss 32 within the channel 16 as best seen in FIG. 2. In the second embodiment as illustrated in FIGS. 8 and 11, a retainer clip 34 is located over the shank portion 22 of the ferrule 14 and functions as the collar. In particular, the retainer clip 34 has a pair of ramped elements 38 which extend into the channels 16 to retain the blades 12 within the ferrule 14. The remaining portion of the blade flank 28 and the edge portion 30 extend outwardly through channel 16 from ferrule 14.

To facilitate sliding of the blade 12 relative to the ferrule 14, the height (x-direction) and width (y-direction) increase along the length (z-direction) from the tip 24 to the shank 22. In this manner, the channels 16 expand slightly in height and in width from a leading end to a trailing end of the ferrule 14 such that the blades 12 slide more freely as they move rearwardly. A relief in the form of an angular relief, a linear relief or a radial relief may also be provided on the lip 36 to promote free sliding movement of the blades 12 within the channels 16.

Figure 3:
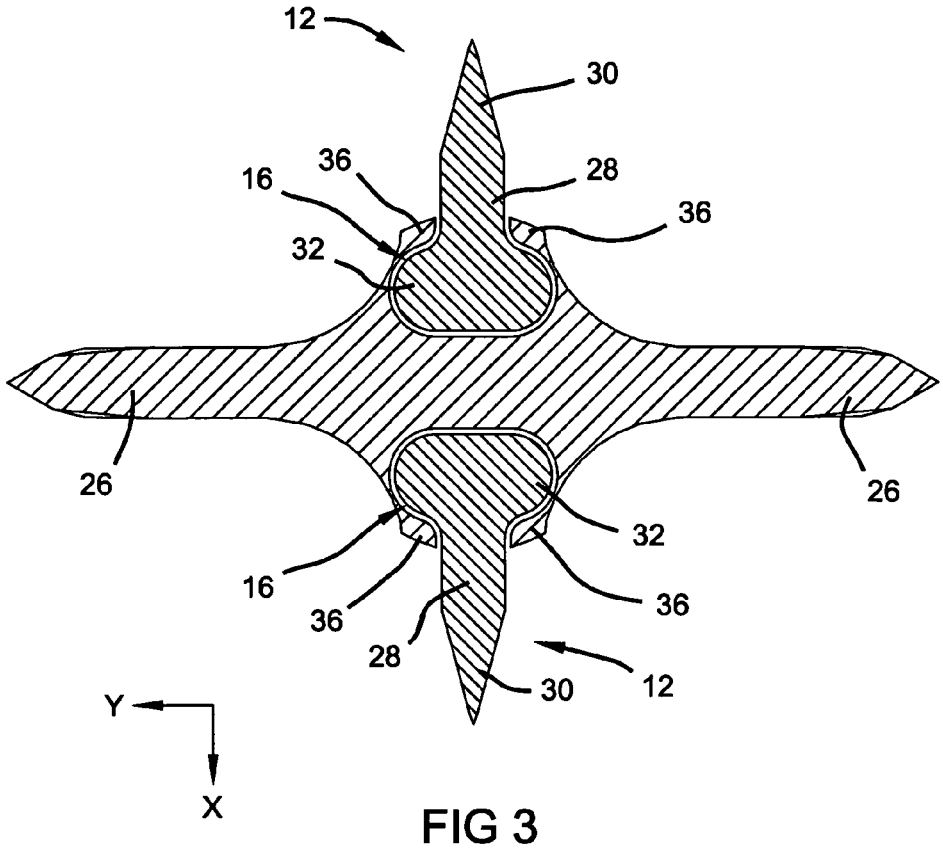
FIG. 3 is a transverse cross-section taken along line III—III shown in FIG. 2.

As best seen in FIGS. 3 and 8–9, the boss 32 is configured as a hemispherical extension which provides a smooth interface within the channel 16 which has a generally elliptical groove. However, one skilled in the art will recognize that the configuration of the boss 32 and the channel 16 may take any suitable form which provides a smooth interface to promote relative sliding movement therebetween.

Figure 4:
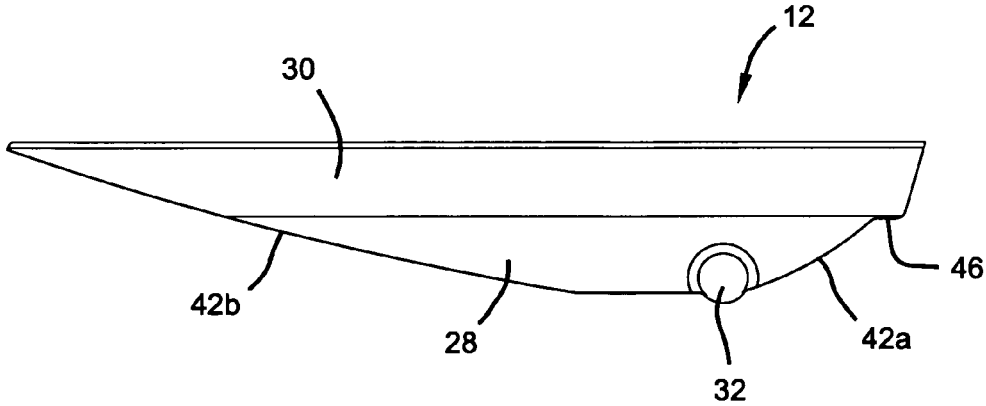
FIG. 4 is a side view of a blade shown in FIG. 2.

With particular reference to FIGS. 4 and 10, each blade 12 has a camming surface 42 formed on the blade opposite edge portion 30. A forward portion 42*a* of the camming surface cooperates with the channel 16 to control the cutting diameter (i.e., the distance between the rear tips of the blades 12) in the deployed position. A rearward portion 42*b* of the camming surface 42 extending rearwardly of the boss 32 cooperates with the collar (defined by the insert 20 in the first embodiment and the ramped elements 38 in the second embodiment) to rotate the blades 12 outwardly as they slide longitudinally rearwardly within the ferrule 14. Thus, the forward and rearward portions 42*a*, 42*b* of the camming surface define a blade travel path 44.

Figure 5:
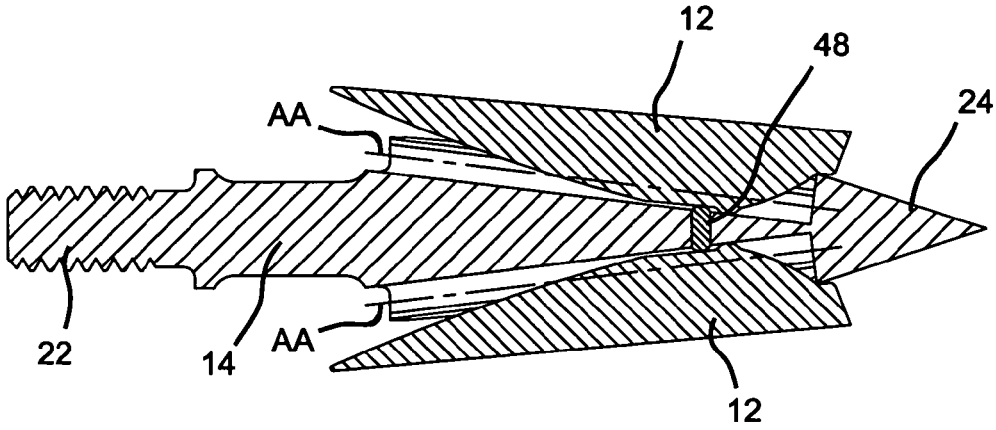
FIG. 5 is a cross-section of the broadhead of FIG. 1 in which the blades are shown in the retracted position.

As presently preferred the geometry of the blades 12 is such that travel within the channel 16 is initially generally parallel to the longitudinal axis A—A of channels 16 formed in the ferrule 14 until the rear camming surface 42*b* engages the collar. At this point the camming surface 42*b* engages the collar such that the blades 12 rotate outwardly as they slide rearwardly in channel 16. The blade travel path described above is illustrated with phantom lines in FIG. 2 and will be more fully appreciated from a comparison of FIGS. 5–7 showing the blades 12 retracted, partially deployed and fully deployed, respectively.

The blades 12 may include other features to enhance the functions of the mechanical broadhead. With reference to the first preferred embodiment, notch 46 may be formed at the end of forward camming portion 42*a* and functions to limit the blades 12 ability to pivot about the boss 32 when in the retracted position. For example, as best seen in FIG. 5, the notch 46 engages the tip portion 24 of the ferrule 14 to achieve this limiting function. One skilled in the art will recognize that the edge portion 30 of the blades 12 are configured to provide sufficient frontal area to engage a target upon impact and initiate the rearward movement of the blades 12 relative the ferrule 14. With reference to the second preferred embodiment, a detent 42*c* may be provided in camming surface 42 to enhance blade retention in the in-flight retracted position as hereinafter described. The blades 12 may also be provided with pockets 44 (or alternatively with windows, not shown) such that the weight and rotational inertia of the blade may be precisely tuned.

A retainer may be utilized to selectively retain the blades in the in-flight retracted position. With reference now to FIGS. 5–7, the first preferred embodiment includes a compliant element 48 disposed within the channels 16 of the ferrule 14. Compliant element 48 functions as friction point within the channel 16 to lightly retain the blades 12 in the in-flight, retracted position. As presently preferred, the compliant element 48 is formed from rubber or urethane and provides slight resistance to rearward sliding movement of the blades 12 in the channel 16. With reference to the second preferred embodiment, the retainer clip 34 includes legs 50 located in respective grooves 52 formed in channel 16 as best seen in FIG. 9. A bump 54 is formed at the forward end of legs 50 to slightly extend from groove 52 into channel 16. Bump 54 cooperates with detent 42*c* formed in camming surface 42 for temporarily retaining the blade 12 in the in-flight retracted position. Retainer clip 34 is made of a resilient material such that bump 54 may be elastically deformed when the blades 12 impact a target, thus initiating rearward movement of the blades 12.

With now reference to FIGS. 12 and 13, a third preferred embodiment is illustrated which utilizes an O-ring 56 located concentrically about the ferrule 14 to releasably retain the blades 12 in the in-flight, retracted position. The O-ring 56 is retained in the groove 58 in the ferrule 14. A hook configuration 60 is formed at the rearward bottom portion or tail of the blade 12 as shown in FIG. 13. As presently preferred, the O-ring is a rubber or other suitable material with sufficient elasticity to releasably retain the blades 12 in the retracted position. The blades 12 are first assembled to the ferrule 14 by inserting the bosses 32 into their respective channels 16. The O-ring 56 is then slipped over the ferrule 14 and positioned in the retaining groove 58 in the ferrule 14. The hook 60 on the blades 12 are engaged with the O-ring 56. Upon impact, the rearward motion of the blades 12 disengages the O-ring 56 allowing the blades 12 to deploy following the travel path generally illustrated in FIG. 2.

The design of the broadhead components, and in particular the ferrule 14 readily lends itself to manufacture utilizing a powder injection molding process. Specifically, the geometric configuration of the channel 16 and the integral features of tip portion 24 are features which may be readily formed utilizing powder injection molding technology. In this regard, U.S. Pat. No. 6,290,903 and U.S. Pat. No. 6,595,881 disclose further details regarding preferred powder injection molding processes for broadheads and broadhead components, the disclosures which are expressly incorporated by reference herein. Additional features, such as scallops formed in the outer surface of the ferrule 14 and the rearwardly expanding channel 16 may be readily included in the design of the present invention. Likewise, the design of the blades 12 and in particular the boss 32, the tapered cross-section of the blade and the pockets (or windows) lends themselves to fabrication utilizing the powder injection molding process.

As noted above, the preferred embodiment of the present invention is illustrated to include a pair of blades 12 operably coupled to the ferrule 14 for sliding movement between the retracted and expanded positions. However, one skilled in the art will readily recognize that the present invention may be readily adapted to provide a broadhead having a configuration with any number of multiple blades as dictated by the specific application. Likewise, a particular design and shape of the ferrule including the tip portion may be modified as dictated by the specific application. For example, as the embodiment illustrated in the drawings presently contemplates an 85 grain broadhead; however, the ferrule 14 may be reconfigured to provide a generally tapered ferrule without the scallops to provide a 100 grain broadhead. The present invention has been described with reference to two preferred embodiments having many common and some distinct features. One skilled in the art will recognize that these features may be used singularly or in any combination based on the requirements and specifications of a given application or design.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An expanding-blade broadhead comprising:

a ferrule having a longitudinal channel formed therein; and a blade having a flank and a boss extending transversely from said blade flank, said boss received in said channel for directly coupling said blade to said ferrule for relative sliding movement within said channel from a retracted position to a deployed position.

2. The expanding-blade broadhead of claim 1 further comprising a collar located adjacent said ferrule to retain said boss in said channel.

3. The expanding-blade broadhead of claim 1 wherein said longitudinal channel has a height and a width, at least one of said height and said width expanding in a direction from a leading end to a trailing end of said ferrule.

4. The expanding-blade broadhead of claim 1 wherein a geometry of said longitudinal channel is complementary to said boss and said ferrule further comprises a lip which cooperates with said boss to retain said blade in said ferrule.

5. The expanding-blade broadhead of claim 4 wherein relief is provided on said lip.

6. The expanding-blade broadhead of claim 1 wherein said blade has a cutting edge formed thereon and a camming surface formed on an edge opposite said cutting edge which cooperates with said channel formed in said ferrule.

7. The expanding-blade broadhead of claim 6 wherein said camming surface engages a collar located adjacent said ferrule to move said blade through a blade travel path.

8. The expanding-blade broadhead of claim 6 wherein said camming surface comprises a radiused section rearward of said boss.

9. The expanding-blade broadhead of claim 8 wherein said camming surface comprises a straight section between said boss and said radiused section.

10. The expanding-blade broadhead of claim 6 wherein said camming surface comprises a radiused portion forward of said boss.

11. The expanding-blade broadhead of claim 1 wherein said blade has a notch formed at a forward end thereof, said notch engaging said ferrule when said blade is in said retracted position to limit rotational movement thereof.

12. The expanding-blade broadhead of claim 1 further comprising a retainer element operable to engage said blade for releasably maintaining said blade in said retracted position.

13. The expanding-blade broadhead of claim 12 wherein said retainer element is disposed within said channel of said ferrule.

14. The expanding-blade broadhead of claim 13 wherein said retainer element comprises a compliant element disposed within the ferrule and partially extending into said channel.

15. The expanding blade broadhead of claim 12 further comprising an elastic element disposed around said ferrule to releasably engage a portion of said blade when said blade is in said retracted position.

16. The expanding blade broadhead of claim 15 further comprising a hook disposed on a tail portion of said blade, said hook operable to engage said elastic element when said blade is in said retracted position.

17. The expanding blade broadhead of claim 15 wherein said ferrule has a groove formed therein, said elastic element being disposed in said groove.

18. The expanding-blade broadhead of claim 1 further comprising a retainer clip having a collar disposed at a trailing end of the ferrule and a leg extending into said longitudinal channel for releasably maintaining said blade in said retracted position.

19. The expanding-blade broadhead of claim 18 wherein said retainer clip further comprises a bump formed on said leg which corporates with a detent formed in said blade.

20. The expanding-blade broadhead of claim 1 wherein said blade comprises a planar flank portion having said boss extending therefrom and a tapered edge portion.

21. An expanding-blade broadhead comprising:

a ferrule having a channel formed therein along a longitudinal axis; and a blade operably coupled to said ferrule for relative sliding movement within said channel from a retracted position along a blade travel path to a deployed position, said blade having a flank portion disposed in said channel which is shorter than the length of said channel;

wherein said blade travel path includes a first section wherein a rear tip of said blade moves generally parallel to said longitudinal axis and a second section wherein said rear tip moves radially outwardly from said longitudinal axis.

22. The expanding-blade broadhead of claim 21 wherein said boss is integrally formed on said flank portion of said blade.

23. The expanding-blade broadhead of claim 21 wherein said blade comprises a camming surface which cooperates with said channel to move said blade along said blade travel path.

24. The expanding-blade broadhead of claim 23 wherein said camming surface comprises a straight section for providing said first section of said blade travel path and a radiused section for providing said second section of said blade travel path.

25. The expanding-blade broadhead of claim 24 wherein said camming surface is formed on an edge of said blade.

26. An expanding-blade broadhead comprising:

a ferrule having a channel formed therein and a lip adjacent said channel;

a blade having a cutting edge, a camming surface opposite said cutting edge and a boss extending transversely from said blade, said boss received in said channel and retained therein by said lip, said boss coupling said blade to said ferrule for relative sliding movement within said channel from a retracted position to a deployed position; and a retainer located adjacent said ferrule to retain said blade in said channel and to cooperate with said camming surface to move said blade through a blade travel path.

27. The expanding-blade broadhead of claim 26 wherein said retainer comprises a ramped element extending into said channel to cooperate with said camming surface.

28. The expanding-blade broadhead of claim 26 wherein said camming surface comprises a radiused section rearward of said boss.

29. The expanding-blade broadhead of claim 28 wherein said camming surface comprises a straight section between said boss and said radiused section.

30. The expanding-blade broadhead of claim 29 wherein a relief is provided on said lip.

31. The expanding-blade broadhead of claim 28 wherein said camming surface comprises a radiused portion forward of said boss.

32. The expanding-blade broadhead of claim 26 wherein said longitudinal channel has a height and a width, at least one of said height and said width expanding in a direction from a leading end to a trailing end of said ferrule.

33. The expanding-blade broadhead of claim 26 wherein a geometry of said longitudinal channel is complementary to said boss and said ferrule further comprises a lip which cooperates with said boss to retain said blade in said ferrule.

34. The expanding-blade broadhead of claim 26 wherein said boss is integrally formed on a flank portion of said blade.

* * * * *